US007810180B2

(12) United States Patent
List

(10) Patent No.: US 7,810,180 B2
(45) Date of Patent: Oct. 12, 2010

(54) BABY BATHTUB CHAIR & KIT

(76) Inventor: Gloria List, 1745 Ukiah St., Oxnard, CA (US) 93035

( * ) Notice: Subject to any disclaimer, the term of this patent is extended or adjusted under 35 U.S.C. 154(b) by 1048 days.

(21) Appl. No.: 11/541,061

(22) Filed: Sep. 29, 2006

(65) Prior Publication Data

US 2007/0074338 A1 Apr. 5, 2007

Related U.S. Application Data

(60) Provisional application No. 60/722,724, filed on Sep. 30, 2005.

(51) Int. Cl.
*A47K 3/024* (2006.01)

(52) U.S. Cl. ..... 4/572.1

(58) Field of Classification Search ..... 4/572.1, 4/573.1, 575.1, 254, 902, 483; 297/118
See application file for complete search history.

(56) References Cited

U.S. PATENT DOCUMENTS 3,258,291 A * 6/1966 Ezquerra ..... 297/153
3,416,163 A * 12/1968 Jordan ..... 4/483
3,567,275 A * 3/1971 Bukey ..... 297/133
4,162,490 A * 7/1979 Fu et al. ..... 340/603
5,071,192 A 12/1991 Adler
5,321,859 A 6/1994 Buckshaw et al.
5,507,550 A 4/1996 Maloncy
5,558,400 A 9/1996 Poulson et al.
5,599,063 A 2/1997 Lister et al.
5,806,922 A 9/1998 Mendclovich
5,940,900 A * 8/1999 Wells ..... 4/515
6,126,236 A 10/2000 Wu
6,247,750 B1 6/2001 Tsai
6,719,371 B2 4/2004 Yoshie et al.
6,877,801 B2 4/2005 Asbach et al.
7,073,212 B1 7/2006 Moffat
7,104,603 B2 9/2006 Keegan et al.
7,134,714 B1 11/2006 Connery

* cited by examiner

*Primary Examiner*—Huyen Le
(74) *Attorney, Agent, or Firm*—W. Douglas English

(57) ABSTRACT

An infant high chair adapted for feeding, entertaining, cleaning, and attending to an infants waste evacuation needs within the safe confines of a bathtub. The chair has four telescoping legs for variable elevation of and supporting a seat with an orthogonal back disposed thereon and having an enlarged hole centered on the seat for passage of the infant's waste to a potty slidably disposed thereunder. A pair of telescoping arms depend orthogonally from the back to a distal cross member from which depend a pair of telescoping legs for support of the arms, thereby providing an enclosure for the infant while seated or standing therein. The arms of the enclosure concomitantly provide a structure to support a play and or eating table/tray.

1 Claim, 6 Drawing Sheets

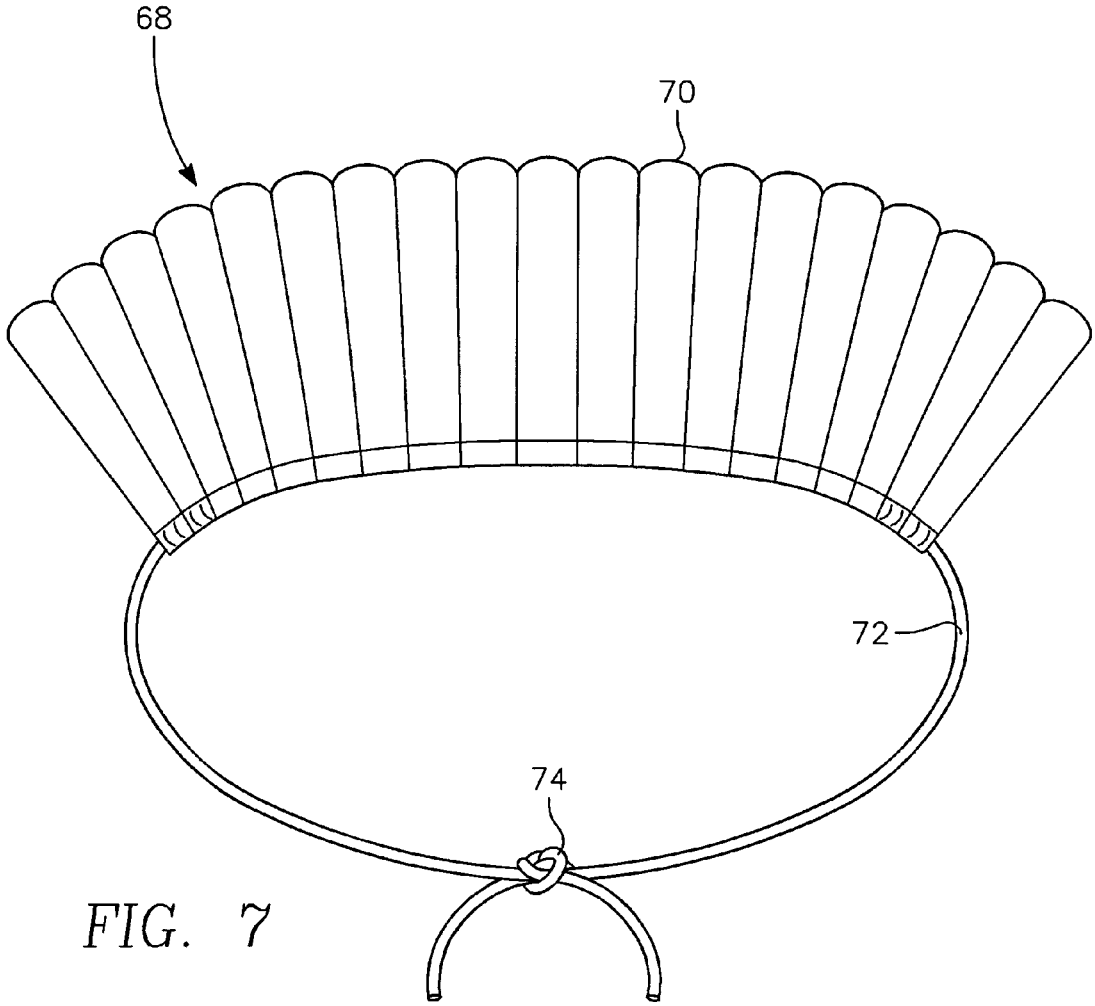
FIG. 7
FIG. 8
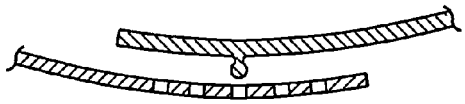
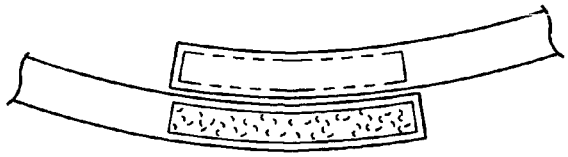
FIG. 9

BABY BATHTUB CHAIR & KIT

BACKGROUND OF THE INVENTION

Many types of baby "high chairs", car seats, swimming pool chairs, and restaurant chairs have been conceived and promoted as a unique chair adapted for a babies and very young children in different or specific environments to protect and prevent babies and very young children from falling out of the chair or in some other manner hurting themselves whilst in the chair. There are, however, very common areas customarily used by babies such as in bathtub where even an adult must take some precaution to prevent an accidental slip and fall and consequent slight or serious injuries.

The invention disclosed herein relates a baby chair that provides protection and entertainment of babies in a bathtub environment, and in particular provides a chair that offers a multifunction adaptation to different needs while concomitantly securing the baby within the chair yet giving the young child a greater degree of mobility within the chair. The baby chair invention fulfills a long standing need for such a versatile baby chair particularly designed for a bathtub environment.

SUMMARY OF THE INVENTION

The invention describes a baby chair adapted for a bathtub environment. The chair has four legs with a multi positioned, variable elevation capacity supporting a back and a seat, wherein the seat has an orifice there through, covered by a potty lid, and a removable "potty" positioned there under. A pair multi positioned, extendable arms extend out from the chair back and are connected by a distal cross bar orthogonally disposed to each said arm; these arms support and confine a baby safely within the chair. The arms are also supported with a pair of multi positioned, extendable legs disposed in front of and running in a plane parallel to that of the chair legs. A tray is designed to snuggly but removeably fit over and across the chair arms for providing a tray in which baby can keep his play things, food, bottle, drinks, etc. The bathtub baby chair kit also includes a bib or shield designed to snuggly fit across the baby's forehead to confine and keep food and drink in their proper places.

DRAWING

FIG. 7 depicts a flat view of the forehead shield secured by a simple tie knot.

FIG. 8 depicts an alternate male/female snap engagement device for said shield.

FIG. 9 depicts yet another engagement means of the forehead shield in the manner of a hook and latch, Velcro type securing device.

DESCRIPTION OF A PREFERRED EMBODIMENT

Figure 1:
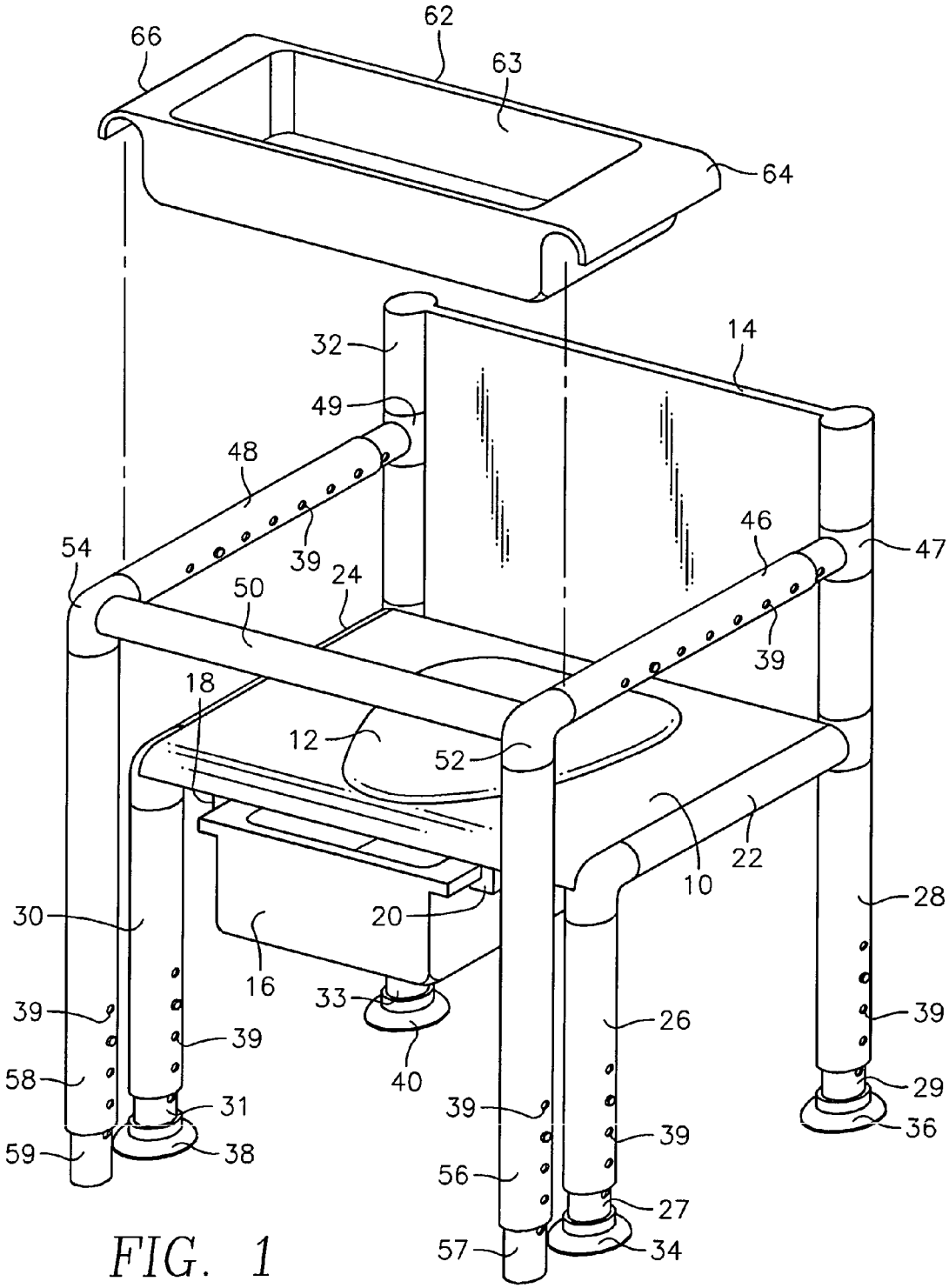
FIG. 1 illustrates a perspective view of the baby chair invention.

The perspective view of FIG. 1 discloses the bathtub baby chair having a seat 10 with an orifice, covered by a potty lid 12, centrally disposed therein. Seat 10 may be made of plastic, wood, or any similar substance that can offer a firm support for the weight of a typical baby. A back 14 of the chair is conventionally positioned orthogonal to the seat 10; back 14 may be made of same substance as seat 10. The baby seat is provided with a potty 16 for baby to relieve himself as the urge occurs; it being understood that the baby may be nude whilst sitting and using the chair in a bathtub. The potty 16 is configured to conveniently slide in and out along a pair of rails 18 and 20 disposed on the underside of the seat 10. A pair of seat rod members 22 and 24 are included in the design to provide additional seat support and also provide a sturdy attachment element for the chair legs, 26 and 28 on one side of the chair and 30 and 32 on the other side of the chair.

Figure 5:
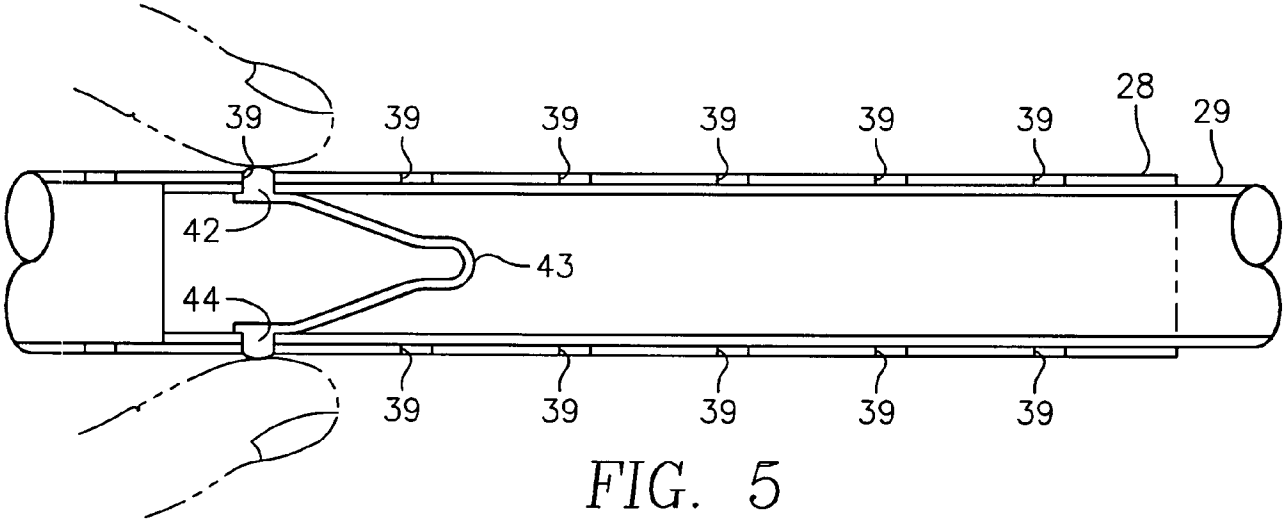
FIG. 5 illustrates how the arm and leg extensions are engaged in a desired position.
Figure 6:
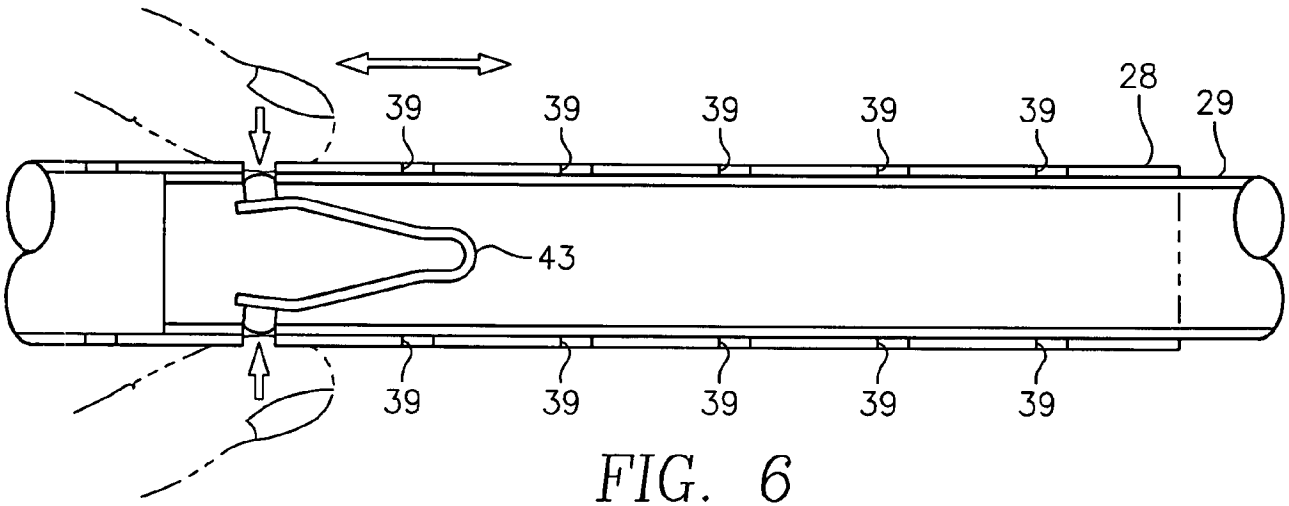
FIG. 6 illustrates how the arm and leg extensions are disengaged to change the length thereof.

It will be noted that all the chair legs 26, 28, 30, and 32 are provided with suction cups 34, 36, 38, and 40 for making a non slip and fixed attachment means for the chair in an often slippery bathtub. It will also be noticed that the chair seat elevation may be changed to accommodate the size of the baby or small child seated therein. Each leg can be changed in length, to raise and lower seat 10 in accord with the snap in locking devices illustrated in FIGS. 5 and 6. Referring to FIGS. 5 and 6, when a pair of spring 43 loaded depressable locking elements 42 and 44 protrude through one of a plurality of holes 39 as in FIG. 5, the leg 28 with its variable length extension 29 is held at a desired and fixed length. When locking element 42 is depressed as in FIG. 6, the leg extension 29 is allowed to move in or out, thereby changing the length of the chair leg 28.

Figure 2:
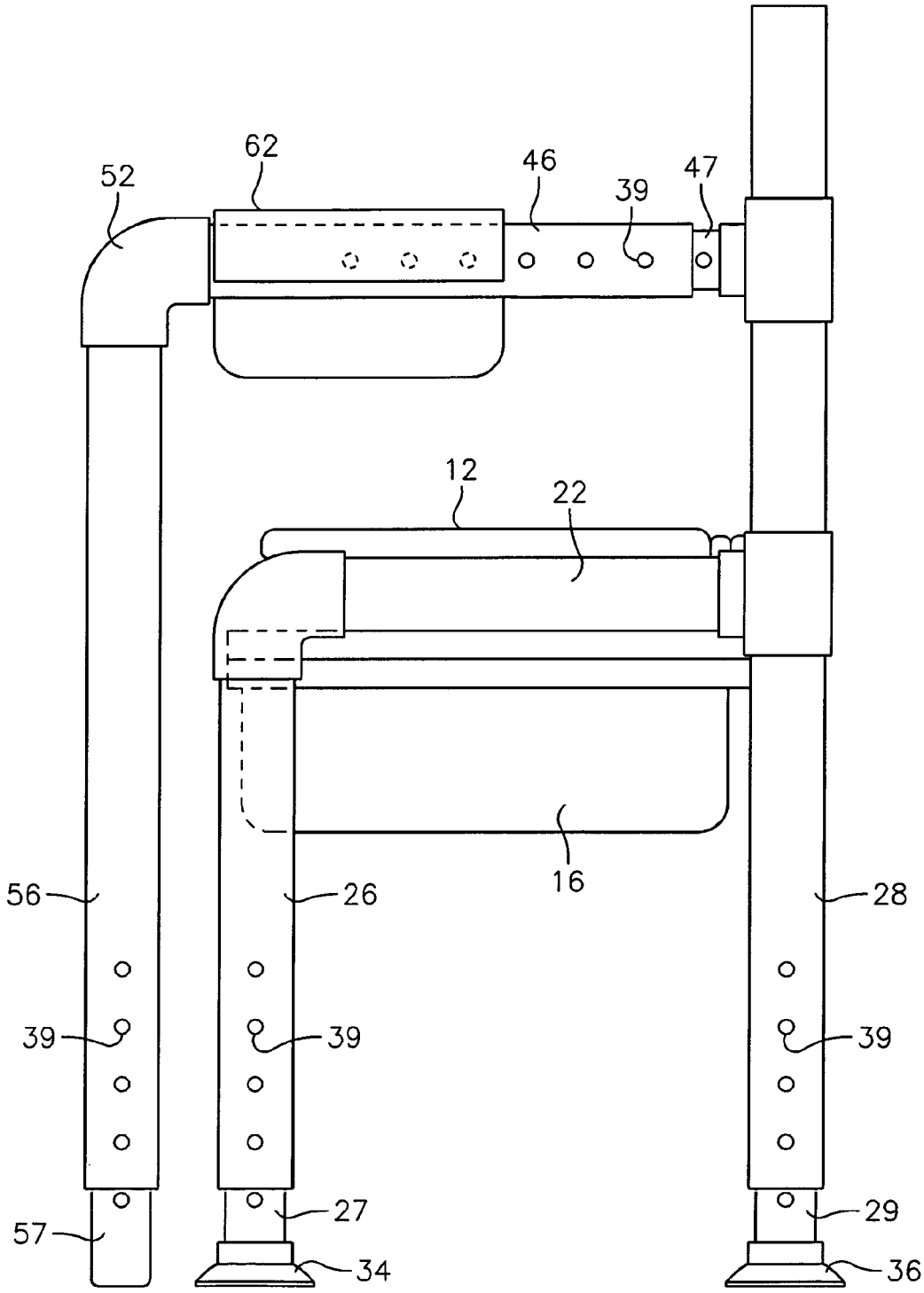
FIG. 2 illustrates an elevational, side view of the baby chair.
Figure 3:
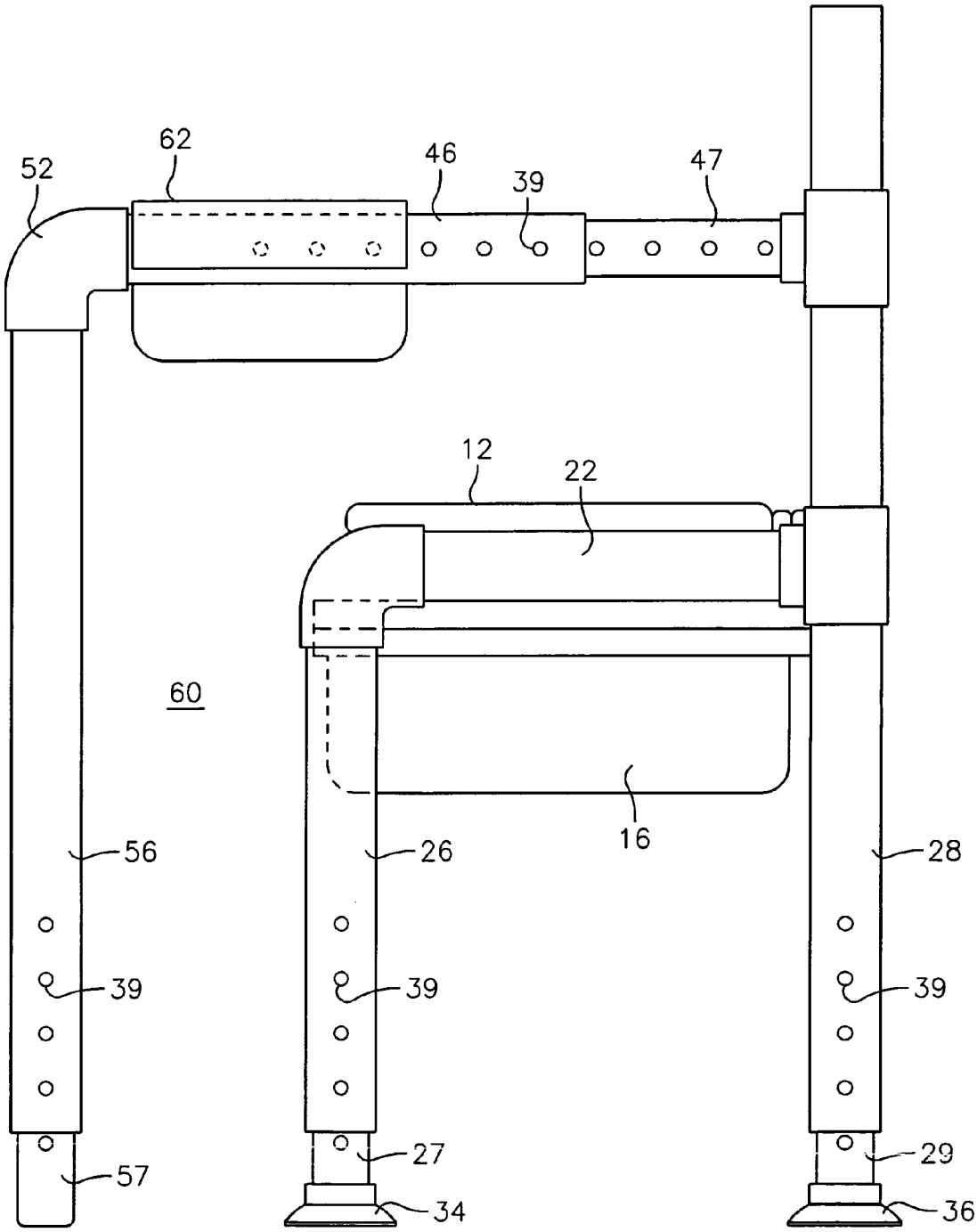
FIG. 3 illustrates an elevational view with the arms extended allowing the young child to stand in front of the chair as well as to sit on the chair.
Figure 4:
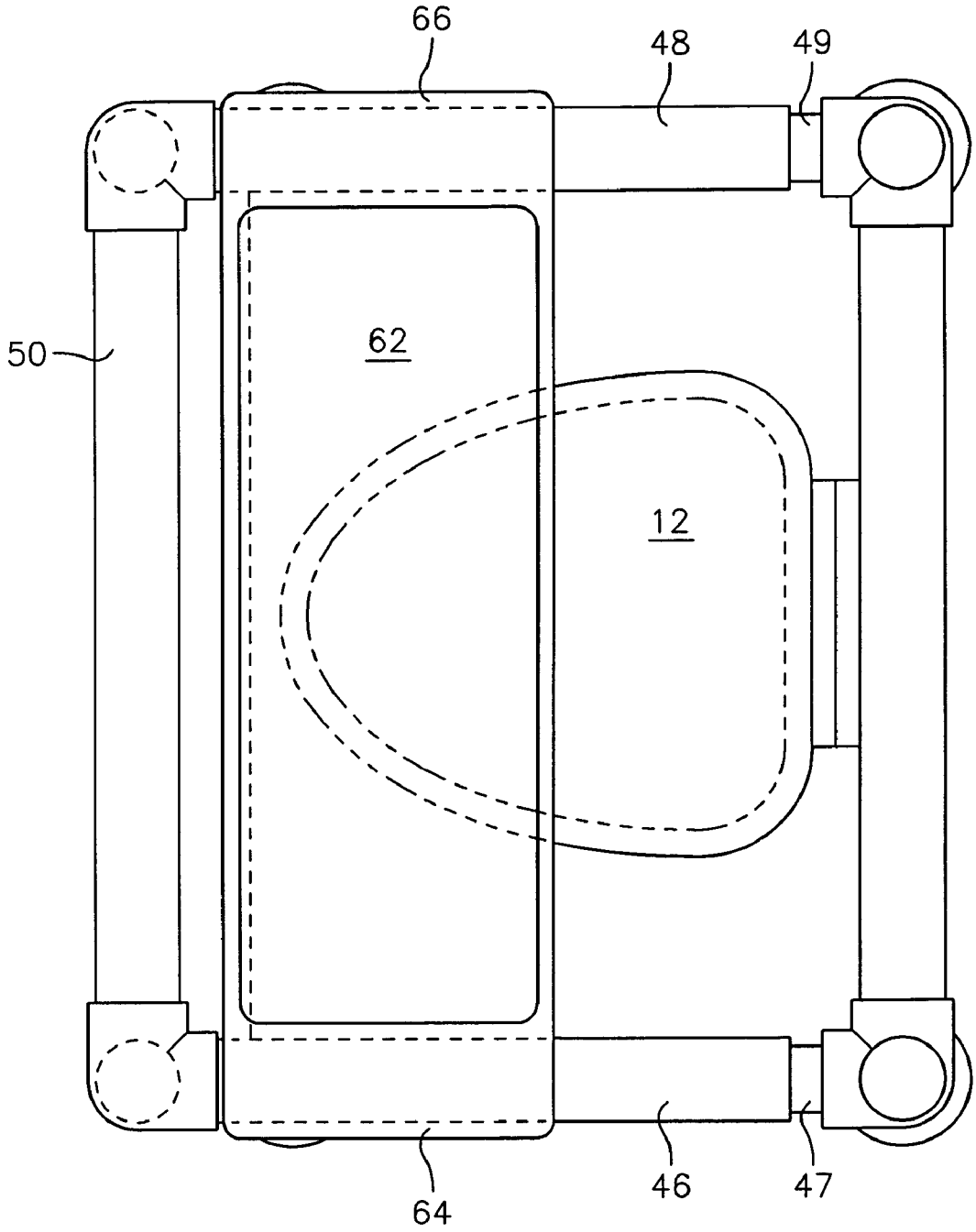
FIG. 4 depicts a plan, top view of the baby chair.

Referring now back to FIG. 1, a pair of extendable arms 46 and 48 that can be adjusted inwardly and outwardly via extensions 47 and 49 by like manner and mechanisms as described above in the legs of the chair. Extendable arms 46 and 48 are joined by a crossbar 50 subjoined by a pair of three way coupling joints 52 and 54. A pair of crossbar 50 legs 56 and 58 extend orthogonally from crossbar 50 in a plane parallel to the chair legs and have extensions 57 and 59 to permit variable length extensions of legs 56 and 58. In such manner, a protective child stand up area 60 is provided that can more clearly be envisioned with a comparison of FIGS. 2 and 3.

A rectangular tray 62 having a recessed bay 63 is also provided in the invention kit that is removeably clasped by overlaps 64 and 66 on chair arms 46 and 48, respectfully. Tray 62 is designed to provide a baby or young child a protective area in which to put his toys, bottles, food containers, water, etc. in a confined space. Finally, the bathtub baby chair kit contains a protective bib 68 illustrated in FIG. 7 that is configured to fit around the head and forehead of a baby to keep water out of baby's eyes and food and other matter out of baby's hair. Bib 68 is designed with a plurality of overlapping folds 70 extending from a band 72. Band 72 may be a string simply tied in place via a knot 74. It is also envisioned that band 72 may be any cloth or plastic strip that may also be connected by alternate means such as snap and clip devices illustrated in FIG. 8 or by Velcro or similar connecting devices illustrated in FIG. 9.

What is claimed is:

1. A bathtub baby chair, comprising:

a chair having a back and seat with four extendable legs;

a potty disposed under said seat;

a pair of arms extending orthogonally from said back and connected by a cross bar at a distal end to form a protective enclosure;

a pair of adjustable legs extending orthogonally from said cross bar to the ground to provide additional support for said enclosure;

a tray removeably disposed across said arms; and a bib adapted to fit across a baby's forehead to protect baby's eyes.

* * * * *